US009278446B2

(12) United States Patent
Lifshitz et al.

(10) Patent No.: US 9,278,446 B2
(45) Date of Patent: Mar. 8, 2016

(54) WORK BENCH INCLUDING A VISE

(71) Applicant: THE STANLEY WORKS ISRAEL, LTD., Rosh Ha'Ayin (IL)

(72) Inventors: Omri Lifshitz, Tel Aviv (IL); Miki Birnbaum, Rehovot (IL)

(73) Assignee: The Stanley Works Israel, Ltd., Rosh Ha'Ayin (IL)

( * ) Notice: Subject to any disclaimer, the term of this patent is extended or adjusted under 35 U.S.C. 154(b) by 218 days.

(21) Appl. No.: 13/955,759

(22) Filed: Jul. 31, 2013

(65) Prior Publication Data

US 2014/0232053 A1 Aug. 21, 2014

(30) Foreign Application Priority Data

Feb. 15, 2013 (EP) ..... 13155480

(51) Int. Cl.

| | |
|---|---|
| ***B25B 1/06*** | (2006.01) |
| ***B25B 1/16*** | (2006.01) |
| ***B25H 1/10*** | (2006.01) |
| ***B25H 1/04*** | (2006.01) |
| ***B25B 1/10*** | (2006.01) |
| ***B25B 23/14*** | (2006.01) |
| ***B25H 1/02*** | (2006.01) |

(52) U.S. Cl.

CPC *B25H 1/10* (2013.01); *B25B 1/103* (2013.01); *B25B 23/141* (2013.01); *B25H 1/02* (2013.01); *B25H 1/04* (2013.01)

(58) Field of Classification Search

USPC ..... 269/139, 184, 189, 219

See application file for complete search history.

(56) References Cited

U.S. PATENT DOCUMENTS

| | | | | |
|---|---|---|---|---|
| 467,781 | A | | 1/1892 | Palm et al. |
| 490,603 | A | | 1/1893 | Schmidt |
| 742,647 | A | | 10/1903 | Herriman |
| 825,151 | A | | 7/1906 | McLean |
| 970,207 | A | | 9/1910 | Foster |
| 1,206,399 | A | | 11/1916 | Bartlett |
| 2,800,819 | A | | 7/1957 | Smith |
| 3,208,744 | A | * | 9/1965 | Slifer, Jr. ..... 269/247 |
| 3,300,204 | A | * | 1/1967 | Ahmer ..... 269/93 |
| 3,565,417 | A | | 2/1971 | Degle |
| 4,127,260 | A | | 11/1978 | Hickman |

(Continued)

FOREIGN PATENT DOCUMENTS

| | | | |
|---|---|---|---|
| CN | 102409436 | | 9/2010 |
| DE | 3219621 | A1 | 12/1983 |

(Continued)

OTHER PUBLICATIONS

European Patent Office, European Search Report dated Sep. 27, 2013.

*Primary Examiner* — Lee D Wilson
*Assistant Examiner* — Shantese McDonald
(74) *Attorney, Agent, or Firm* — Stephen R. Valancius

(57) ABSTRACT

A work bench including a frame and a table surface connected to the frame. The table surface includes first and second table surface members. The first table surface member is movably coupled with the frame and has first and second ends. The work bench also includes a first user-actuatable drive member for moving the first end of the first table surface member, a second user-actuatable drive member for moving the second end of the first table surface member and a third user-actuatable drive member for moving the first end and the second end of the first table surface member concurrently.

19 Claims, 3 Drawing Sheets

(56) References Cited

U.S. PATENT DOCUMENTS

| | | | | |
|---|---|---|---|---|
| 4,155,386 | A | 5/1979 | Alessio | |
| 4,159,821 | A | 7/1979 | Hickman | |
| 4,278,243 | A | 7/1981 | Alessio | |
| 4,378,107 | A | 3/1983 | Wagster et al. | |
| 4,415,149 | A | 11/1983 | Rees | |
| 4,489,928 | A * | 12/1984 | Dietrich | 269/251 |
| 4,555,099 | A | 11/1985 | Hilton | |
| 4,798,371 | A | 1/1989 | Wallisser | |
| 5,060,920 | A | 10/1991 | Engibarov | |
| 5,127,639 | A | 7/1992 | Tucker et al. | |
| 5,301,934 | A | 4/1994 | Lynn et al. | |
| 5,524,872 | A | 6/1996 | Lewin et al. | |
| 5,806,947 | A | 9/1998 | Meisner et al. | |
| 5,924,684 | A | 7/1999 | Cheng | |
| 6,170,813 | B1 | 1/2001 | Bowers | |
| 6,247,771 | B1 | 6/2001 | Miller | |
| D448,200 | S | 9/2001 | Sagol | |
| 6,299,152 | B1 | 10/2001 | Sangmeister | |
| 6,578,856 | B2 | 6/2003 | Kahle | |
| 6,755,408 | B2 | 6/2004 | Walter | |
| 6,817,445 | B2 | 11/2004 | Slemmer | |
| 6,830,273 | B2 | 12/2004 | Michler et al. | |
| 7,090,210 | B2 | 8/2006 | Lawrence et al. | |
| 7,134,652 | B2 | 11/2006 | Smith | |
| 7,182,302 | B2 | 2/2007 | Noniewicz | |
| 7,232,120 | B2 * | 6/2007 | Campbell et al. | 269/139 |
| 7,328,890 | B2 | 2/2008 | Kent | |
| 7,380,778 | B2 | 6/2008 | Lawrence et al. | |
| D606,391 | S | 12/2009 | Hughes | |
| 7,690,408 | B2 | 4/2010 | Sugiura | |
| 7,703,726 | B2 | 4/2010 | Harrison et al. | |
| 8,152,149 | B2 | 4/2012 | Lawrence et al. | |
| 8,220,786 | B2 | 7/2012 | Armstrong et al. | |
| 2004/0208951 | A1 | 10/2004 | Bealer | |
| 2011/0283610 | A1 | 11/2011 | Dinihanian | |
| 2011/0316212 | A1 | 12/2011 | Jones et al. | |

FOREIGN PATENT DOCUMENTS

| | | | |
|---|---|---|---|
| DE | 9320286 | | 4/1994 |
| DE | 102006024291 | A1 | 11/2007 |
| EP | 474935 | A1 | 11/1994 |
| EP | 0921911 | | 6/1999 |
| EP | 1228790 | A1 | 8/2002 |
| GB | 2050211 | A | 1/1981 |
| GB | 1595523 | A | 8/1981 |
| JP | 2008006541 | A | 1/2008 |
| WO | 9304820 | A1 | 3/1993 |

* cited by examiner

WORK BENCH INCLUDING A VISE

CROSS-REFERENCE TO RELATED APPLICATIONS

This application claims priority to EP Patent Application No. EP 13155480.0 filed Feb. 15, 2013, the contents thereof to be incorporated herein by reference in its entirety.

FIELD OF THE INVENTION

The present invention relates to portable work benches or tables which include an integral clamping table or vise. More particularly, the present invention relates to a work table with a clamping table or vise where the vise may be operated with one hand.

BACKGROUND OF THE INVENTION

Carpenters, woodworkers and handymen who work with wood as well as other materials, often need a work bench or table which may be utilized to hold workpieces. Ordinarily, these work benches include a frame and a table surface connected to the frame, the table surface including at least two substantially flat members. One of the members is movably coupled with said frame in order to enable clamping of a workpiece between said members. These tables may be versatile, may provide for secure clamping, and may be compact and adjustable.

Such work benches ordinarily includes two vise screws with handles on each one. The vise screws, via the handles, may be operated by the user with the user using both hands. Both handles must be rotated in order to clamp a workpiece between the clamping table members. A transmission belt or chain connecting the two screws may be provided, such that both of the screws may be cranked using only one hand. One handed cranking of the vise to clamp the workpiece allows the user to hold the workpiece in place with his other hand.

However, such mechanisms can be difficult to operate or stiff to turn, since the turning force for both screws must be applied via one handle. It is also desirable to increase the ease and convenience of the clamping operation.

BRIEF SUMMARY OF THE INVENTION

Accordingly, it is an object of the present invention to provide an improved vise for a work bench which enables the vise to be easily and quickly tightened using one hand.

In accordance with the invention, there is provided a work bench comprising a frame and a table surface connected to the frame. The table surface includes at least two members, one of which is movably coupled with the frame to enable clamping of a workpiece between the two table surface members. A drive mechanism moves one of the table members with respect to the other table member. The drive mechanism comprises a first screw coupled with the movable member, a second screw coupled with the movable member and spaced apart from the first screw, a first screw sprocket coupled with the first screw, a second screw sprocket coupled with the second screw and an intermediate shaft carrying a first and second intermediate sprocket, wherein each intermediate sprocket has a larger diameter than the respective screw sprocket. The drive mechanism also comprises a first transmission belt or chain coupling the first screw sprocket to the first intermediate sprocket and a second transmission belt or chain coupling the second screw sprocket to the second intermediate sprocket, and the drive mechanism is arranged such that the movable member may be moved by turning the intermediate shaft. The drive mechanism reduces the time required to drive the screws.

One or both screws may further include a screw handle. The intermediate shaft may be provided with a drive handle which is activatable to turn the intermediate shaft. The drive handle may be a crank-type handle. The work bench may be provided with a drive motor which is activatable to turn the intermediate shaft. The drive motor may be activatable by a switch, and the unit may be cordless (battery powered) or corded (mains powered). If both a drive handle and a drive motor are provided, the user may be able to choose which means to use each time the drive mechanism is actuated.

The intermediate shaft may be approximately equidistant from the first and second screws, and may extend parallel to the first and second screws in or close to the plane defined by the axes of the first and second screws. The intermediate shaft and drive handle or drive motor switch may be located near the front centre of the work bench, allowing the drive handle to be operated conveniently and maximising the stability of the work bench during use.

At least one clutch may be coupled with at least one screw to limit clamping pressures on the workpiece, and to limit stress and load on the transmission belt. The clutch or clutches may be arranged as in EP0921911, for example. The clutch enables rotation of one screw with respect to the other screw so that irregular workpieces may be clamped between the table members and clamping of the workpiece may be accomplished by rotation of the handle by one hand of the operator. Both first and second screws may include a separate clutch.

One or more of the clutches may comprise a spring and a pin removably coupled within notches of the screw sprocket, and may be self-actuating.

The frame may include a guard in order to protect at least a part of the first or second transmission belt or chain by preventing access from one or more directions.

BRIEF DESCRIPTION OF THE DRAWINGS

The invention is herein described, by way of example only, with reference to the accompanying drawings, wherein.

DETAILED DESCRIPTION OF THE INVENTION

Figure 1:
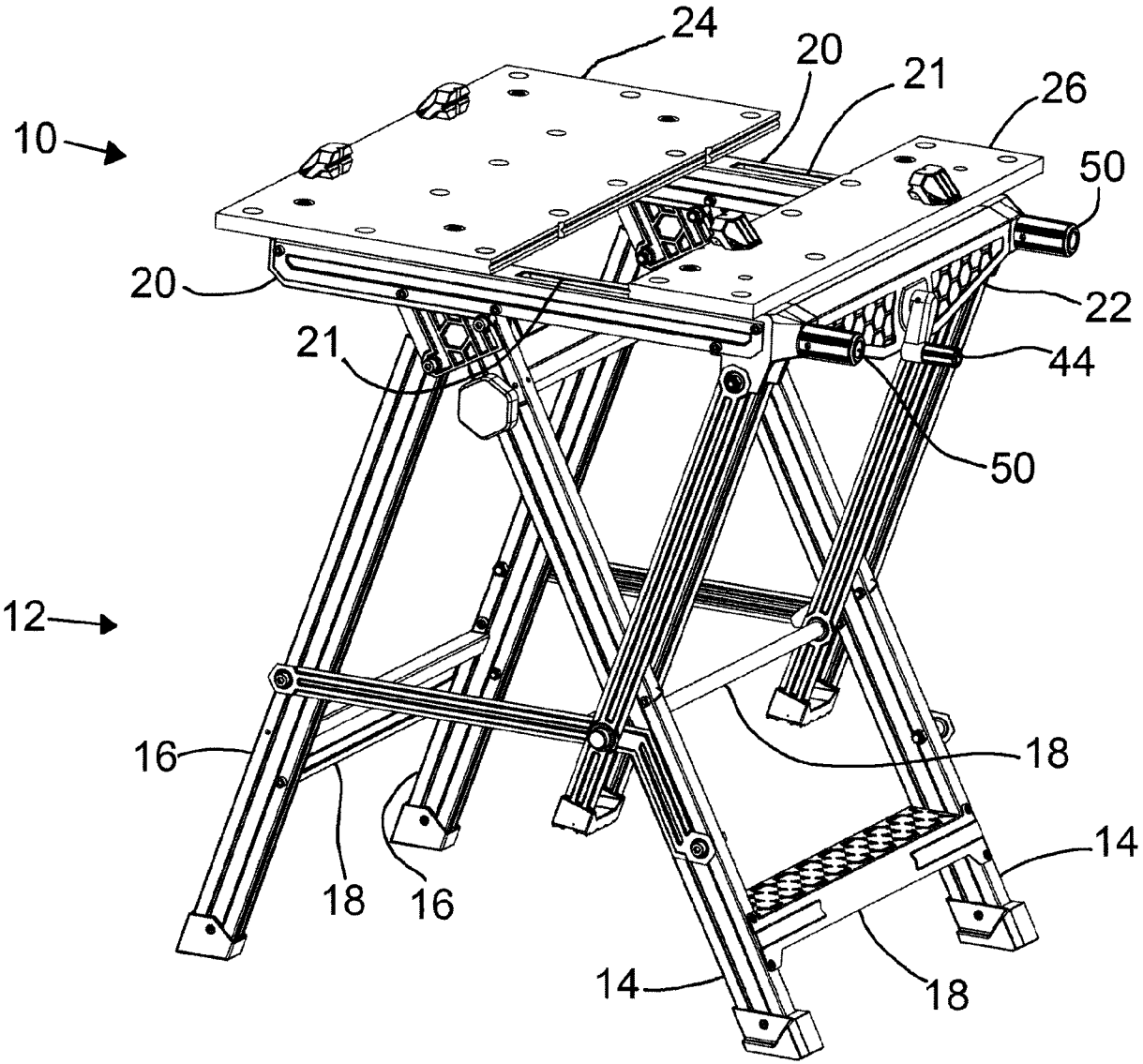
FIG. 1 is a perspective view of a work bench in accordance with the present invention.

The preferred embodiment of the present invention is a work bench which is identified with the reference numeral 10. The work bench includes a frame structure 12 which has two sides, the two sides connected to each other with one or more crossbars 18. Each side of the frame 12 includes a front leg 14, a rear leg 16 and a bracket 20, the bracket providing support for the table surface. The table surface comprises two members 24 and 26, one of which is movable with respect to the frame. As shown in FIG. 1, the brackets 18 may be spaced apart from each other, and are preferably positioned close to opposing outer side edges of the two table surface members 24 and 26, so that the brackets do not unnecessarily prevent sections of clamped workpieces from being able to protrude down in-between the two table surface members.

Figure 2:
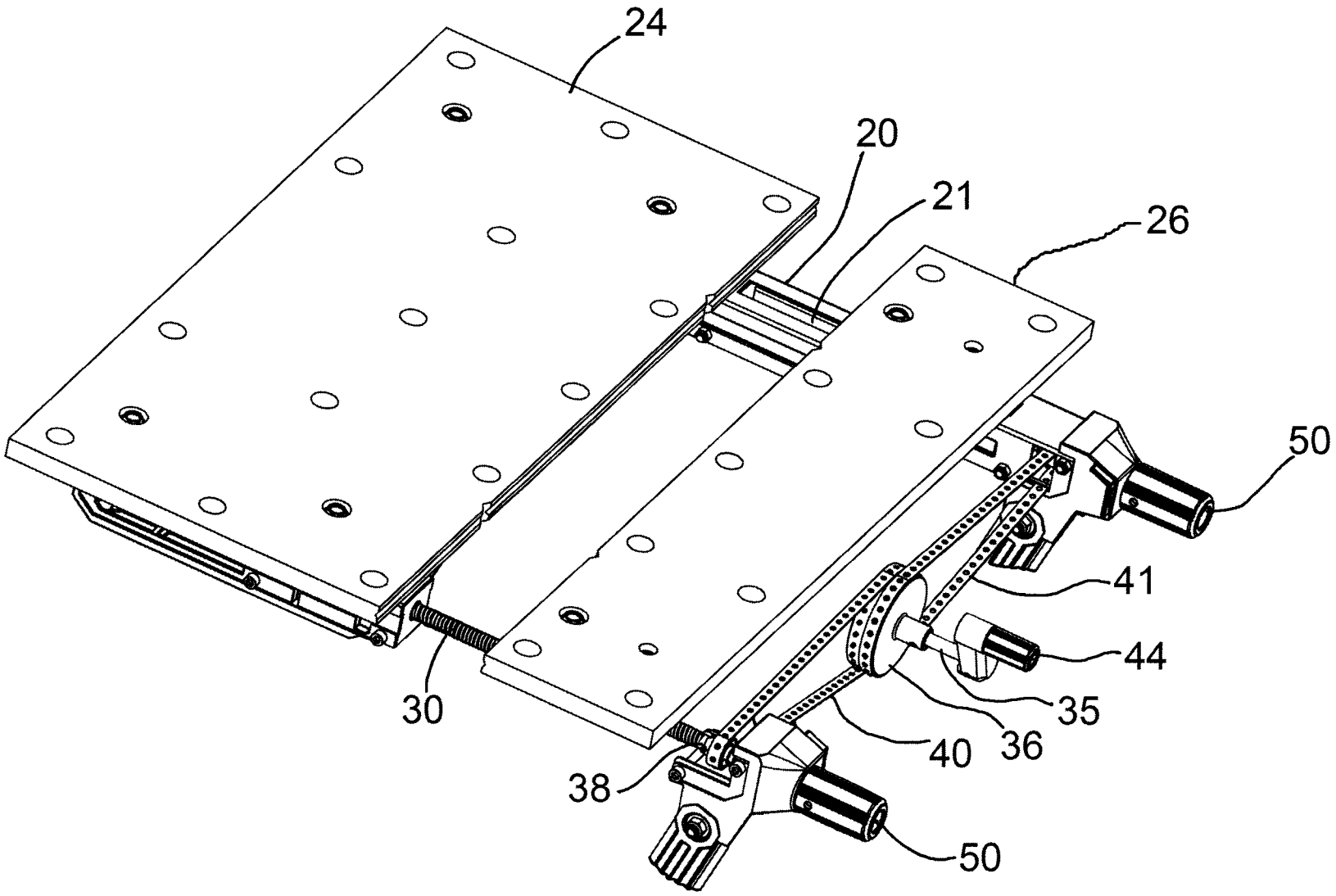
FIG. 2 is a cutaway partial view of the table surface and drive mechanism of the work bench of FIG. 1, in which the frame legs are truncated.

The brackets include means to enable the second table portion 26 to be fixed onto the brackets 20, for example by a nut and bolt connection. The brackets 20 have a hollow portion and include elongated slots 21 in the surface adjacent to the movable table surface member 26, which enables movement of the movable table surface member 26 with respect to the brackets 20. A screw 30 is positioned within each bracket 20. The screws include a threaded portion 32 which carries a threaded nut coupled with the movable table surface member 26. In FIG. 2, part of the near-side bracket 20 is not shown, revealing the screw 30 and other features which would otherwise be hidden. The coupling between the threaded nut and the movable table surface member 26 extends through the slot 21. Rotation of the screws 30 within the brackets 20 forces the threaded nuts to move along the screws, which causes the movable table surface member 26 to move laterally towards or away from the other table surface member 24, depending on the direction of rotation of the screws.

An intermediate shaft 35 is connected to the frame. In the embodiment shown in the Figures, the intermediate shaft 35 is located in between the two screws 30, approximately equidistant from them. The intermediate shaft 35 carries two intermediate sprockets 36, and the two screws each carry a smaller diameter screw sprocket 38. One of the intermediate sprockets 36 is connected to one of the screw sprockets 38 by a first transmission belt 40, and the other of the intermediate sprockets 36 is connected to the other of the screw sprockets 38 by a second transmission belt 41. In the embodiment shown in the Figures, each sprocket has a plurality of projections which engage with apertures in the transmission belt 40, 41. Any known alternative mechanism for transmitting rotational movement may be used, for example the transmission belts may be replaced by transmission chains which cause the sprockets to rotate, for example by engaging with recesses of the sprockets. The frame includes a guard 22 at the front, which partially supports the intermediate shaft 35 and which shields the sprockets and transmission belts in order to protect them, for example from being knocked by the user or tangled with other equipment.

A drive handle 44, which may be a crank-type handle as shown in the

Figures, is attached to the intermediate shaft 35. If a drive motor is provided to turn the intermediate shaft, this may be attached to the frame in any suitable sheltered location, preferably close or adjacent to the intermediate shaft, and a drive motor switch may be provided, for example on the front or top of the frame 12. Turning the intermediate shaft 35 drives both transmission belts 40, 41, such that the two screws 30 are caused to rotate simultaneously, and the movable table surface member 26 is moved. A workpiece can thereby be clamped between the two table surface members 24, 26, or released. The user can turn intermediate shaft 35 with one hand, which allows the user to hold the workpiece in place with his other hand. Each screw 30 is connected to a handle 50 which can also be used to turn the screws. The handles 50 are suitable for fine-adjustments or final tightening of the vice formed by the two table surface members. The large size of the two intermediate sprockets allows the movable table surface member 26 to be moved a given distance with fewer rotations of a handle than would be possible using handles 50 alone.

Figure 3:
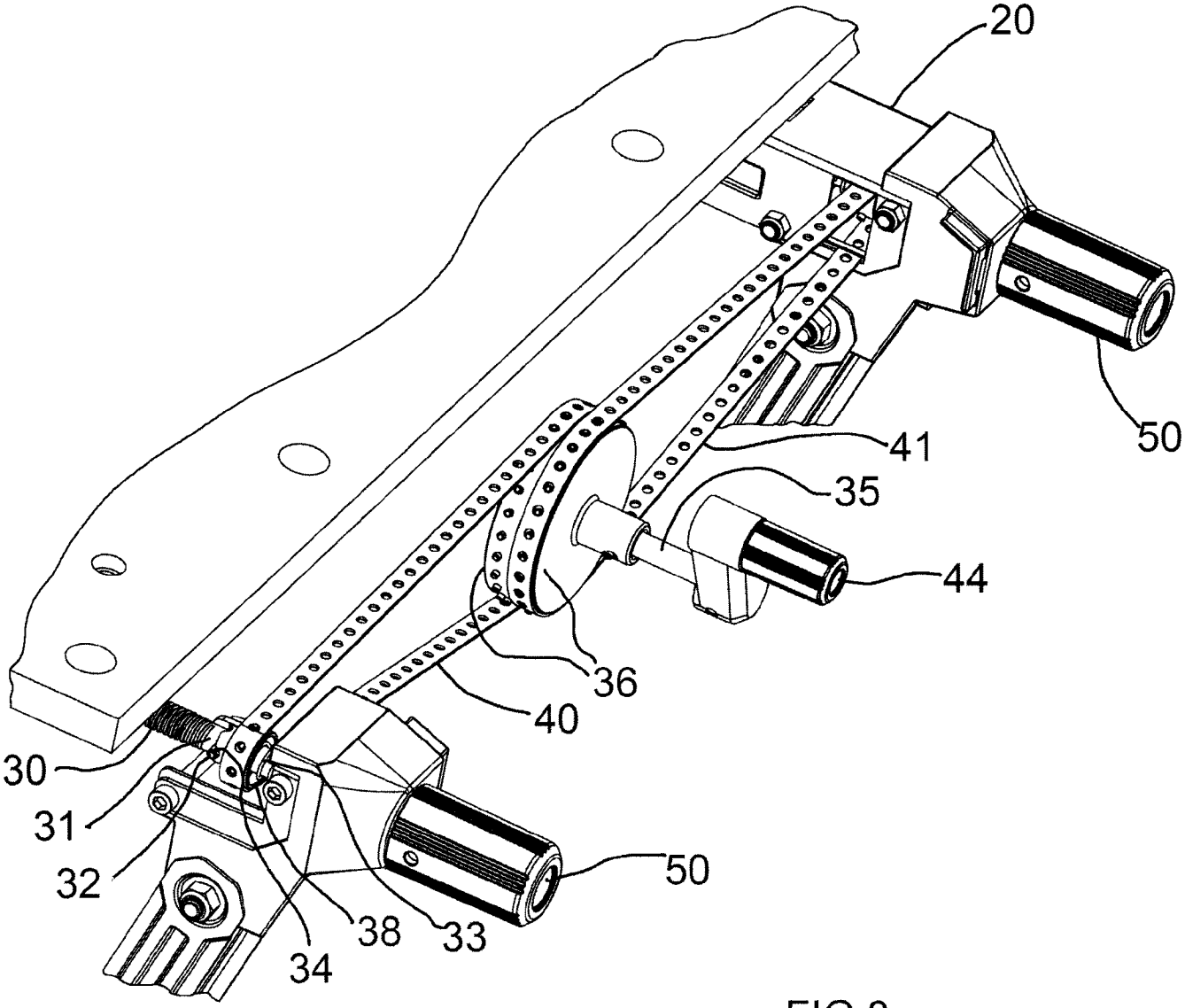
FIG. 3 is a close-up view of the drive mechanism of FIG. 2.

As shown in detail in FIG. 3, a clutch mechanism may be provided on the screw 30 to limit the pressure applied to the workpiece when the vice is being tightened. Screw 30 includes a smooth shank portion 31 on which sprocket 38 is positioned. The smooth shank portion 31 also carries a pin 32 and a helical spring 33. Helical spring 33 urges the sprocket 38 towards the pin 32, and notches 34 of the sprocket engage with the pin 32. During normal operation, sprocket 38 is driven by intermediate shaft 35 in order to turn the screw 30. At high clamping torques, the pin 32 disengages from the respective notch 34 and the sprocket is shifted, compressing the clutch spring 33. When the high clamping pressure is released, the spring 33 forces the sprocket to reengage with the pin 32 to allow full operation of the screw 30.

Preferably both screws carry a similar clutch mechanism, which enables the user to clamp an irregularly shaped workpiece using one hand to turn the intermediate handle to quickly rotate both screws. Once one side of the movable table surface member clamps the workpiece tightly, the clutch on that side will disengage the screw sprocket from the screw on that side, so that continuing to turn the intermediate handle will only cause the other side of the movable table surface member to continue to tighten. Once the irregular workpiece is held by the vice, the handles 50 can be used to fine-tune the clamping forces on both sides of the movable table member.

The transmission belts may be made of any suitable flexible material, for example plastic, rubber, metal chain or fabric. The table surface may be made of any suitable solid or laminated material, for example wood, bamboo, wood-like material or plastic. The frame structure is preferably made of metal, but could be made of any other suitably rigid material, for example, wood or reinforced plastic. The parts of the frame which contact the surface on which the work bench is supported, including the lower ends of the front and rear legs, may be provided with plastic or rubber feet in order to minimise slippage on the supporting surface on which the work bench is placed.

It should be understood that although the invention has been described in conjunction with specific embodiments thereof, it is evident that many alternatives, modifications and variations will be apparent to those skilled in the art. Accordingly, it is intended to embrace all such alternatives, modifications and variations that fall within the scope of the claims.

The invention claimed is:

1. A work bench comprising;

a frame;

a table surface connected to the frame, said table surface including at least two members, at least one of said members movably coupled with said frame for enabling clamping of a workpiece between said members; and a drive mechanism comprising;

a first screw coupled with the movable member;

a second screw coupled with the movable member and spaced apart from the first screw;

a first screw sprocket coupled with the first screw;

a second screw sprocket coupled with the second screw;

an intermediate shaft carrying a first and, second intermediate sprocket, wherein each intermediate sprocket has a larger diameter than the respective screw sprocket;

a first transmission linkage coupling the first screw sprocket to the first intermediate sprocket; and a second transmission linkage coupling the second screw sprocket to the second intermediate sprocket;

wherein the drive mechanism is arranged such that the movable member may be moved by turning the intermediate shaft.

2. A work bench according to claim 1, further comprising a drive handle which is activatable to turn the intermediate shaft.

3. A work-bench according to claim 1, further comprising a drive motor which is activatable to turn the intermediate shaft.

4. A work bench according to claim 1, wherein the intermediate shaft is approximately equidistant from the first and second screws.

5. A work bench according to claim 1, further comprising at least one clutch coupled with at least one screw for limiting clamping pressure on the workpiece, said clutch enabling rotation of one screw with respect to the other screw so that irregular workpieces may be clamped between said members.

6. A work bench according to claim 5, wherein the first and second screws both include a clutch for limiting clamping pressure on the workpiece.

7. A work bench according to claim 5, wherein at least one clutch comprises a spring; a pin; and a notch of the respective screw sprocket, and wherein said clutch is self actuating.

8. A work bench according to claim 1, wherein the first transmission linkage the and the second transmission linkage each comprise at least one of a belt and a chain.

9. A work bench according to claim 1, further including a guard arranged to protect at least a part of the first or second transmission belt or chain.

10. A work bench comprising;

a frame;

a table surface connected to the frame, said table surface including a first table surface member and a second table surface member, at least the first table surface member being movably coupled with said frame for enabling clamping of a workpiece between said first table surface member and said second table surface member;

wherein the first table surface member has a first end and a second end;

the work bench further comprising a first user-actuatable drive member for moving the first end of the first table surface member; a second user-actuatable drive member for moving the second end of the first table surface member; and a third user-actuatable drive member for moving the first end and the second end of the first table surface member concurrently.

11. The work bench according to claim 10, further comprising a linkage between the third user-actuatable drive member and the first and second user-actuatable driver members.

12. The work bench according to claim 11, wherein the linkage comprises at least one of a belt and a chain.

13. The work bench according to claim 11, wherein the first user-actuatable drive member includes a first screw sprocket, the third user-actuatable drive member includes a first intermediate screw sprocket and the linkage couples the first screw sprocket to the first intermediate screw sprocket.

14. The work bench according to claim 13, wherein the second user-actuatable drive member includes a second screw sprocket, the third user-actuatable drive member includes a second intermediate screw sprocket and the linkage couples the second screw sprocket to the second intermediate screw sprocket.

15. The work bench according to claim 14, wherein the first intermediate screw sprocket has a larger diameter than the first screw sprocket.

16. The work bench according to claim 15, wherein the second intermediate screw sprocket has a larger diameter than the second screw sprocket.

17. A work bench comprising;

a frame;

a table surface connected to the frame, said table surface including a first table surface member and a second table surface member, at least the first table surface member being movably coupled with said frame for enabling clamping of a workpiece between said first table surface member and said second table surface member;

wherein the first table surface member has a first end and a second end;

wherein the first end is coupled to a first vise screw which drives movement of the first table surface member at the first end;

wherein the second end is coupled to a second vise screw which drives movement of the first table surface member at the second end;

a first handle operable to drive the first vise screw;

a second handle operable to drive the second vise screw;

a third handle operable to simultaneously drive both the first and the second vice screws.

18. The work bench according to claim 17, wherein the third handle is disposed between the first handle and the second handle.

19. The work bench according to claim 17, further comprising a linkage operatively coupling the third handle to the first and second vice screws.

* * * * *